United States Patent [19]

Sasao et al.

[11] Patent Number: 4,779,708

[45] Date of Patent: Oct. 25, 1988

[54] CONTROL DEVICE FOR AN ELEVATOR

[75] Inventors: Isao Sasao; Yoshio Miyanishi; Takanobu Masaki, all of Inazawa, Japan

[73] Assignee: Mitsubishi Denki Kabushiki Kaisha, Japan

[21] Appl. No.: 143,073

[22] Filed: Jan. 12, 1988

[30] Foreign Application Priority Data

Jan. 16, 1987 [JP] Japan ..... 62-7894

[51] Int. Cl.[4] ..... B66B 1/30

[52] U.S. Cl. ..... 187/119

[58] Field of Search ..... 187/105, 119

[56] References Cited

U.S. PATENT DOCUMENTS 4,519,479 5/1985 Tanahashi ..... 187/105

4,600,088 7/1986 Yonemoto ..... 187/119

4,623,042 11/1986 Kamaike ..... 187/119

4,625,834 12/1986 Tanahashi ..... 187/119

4,629,035 12/1986 Tanahashi et al. ..... 187/119

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

A control device for an elevator which automatically regulates an offset to correct the offset amount contained in a control signal applied to the base circuit of an inverter for driving the hoisting motor of the elevator with a regulator for generating the control signal to detect the output current of the inverter while the elevator is stopped to operate to correct the current to a predetermined value or lower, thereby holding the corrected value even during the operation of the elevator.

7 Claims, 4 Drawing Sheets

CONTROL DEVICE FOR AN ELEVATOR

BACKGROUND OF THE INVENTION

The present invention relates to improvements in an apparatus for controlling the drive of an elevator by an inverter control system.

Heretofore, there has been an elevator in which an induction motor is used as a hoisting electric motor for elevating upward or downward a cage, the induction motor being controlled to be driven by a drive controller employing an inverter.

Such a drive controller for an elevator is disclosed, for example, in the official gazette of Japanese Patent Application Laid-open No. 60-2075, and is shown in FIGS. 5 and 6.

In FIG. 5, this drive controller inputs a three-phase A-C output from a three-phase A-C power source 1 through a switch 2 to a power converter 3, and the power converter 3 converts the three-phase A-C output into a D-C output.

The D-C output of the power converter 3 is smoothed by a capacitor 4, the smoothed output is input to a transistor inverter 5 of a power inverter, the three-phase A-C output converted from the D-C output by the inverter 5 is applied to a hoisting motor 6 formed of an induction motor to drive the hoisting motor 6.

Since a sheave 7 connected to the rotational shaft of the hoisting motor 6 is thus rotated, a cage 10 is elevated upward or downward by a hoisting rope 9 wound on the sheave 7 and coupled at one end with a balance weight 8 and at the other end with the cage 10.

A command speed signal $P_A$ from a pattern generator 11 for generating the speed pattern for the cage 10, a detection speed signal $P_B$ from a tachometer generator 12 for detecting the rotating speed of the hoisting motor 6, i.e., the running speed of the cage 10 and a detection current signal $I_A$ of a feedback signal from a current detector 13 for detecting the three-phase output current of the inverter 5 are input to a regulator 14 of a power inverter controller.

Thus, the regulator 14 alternatively base-drives the transistors of the inverter 5 in accordance with the input signals $P_A$, $P_B$, $I_A$ to control A-C to D-C conversion, thereby controlling the rotating speed of the hoisting motor 6, i.e., the running speed of the cage 10.

The regulator 14 has, as shown, for example, in FIG. 6, a current commanding circuit 15 for comparing the command speed signal $P_A$ from the pattern generator 11 with the detection speed signal $P_B$ from the tachometer generator 12 to generate a command current signal $I_B$, a subtractor circuit 16 for comparing the command current signal $I_B$ with the detection current $I_A$ from the current detector 13 to output the difference value thereof, an amplifier 17 for amplifying the output of the subtractor, a pulse-width modulator (PWM) circuit 18 for pulse-width-modulating the output of the amplifier 17 to output a pulse-width-modulation pulse, and a base driver circuit 19 having transistors controlled ON, OFF by the output pulse of the PWM circuit 18 to output a base drive signal $P_C$ to the inverter 5.

The cage 10 must be controlled to provide speeds which change smoothly in a wide range from a start to a stop operation, and the controlling characteristics of the cage largely depends upon the detecting accuracy of the current detector 13.

The current detector 13 generally outputs a small signal even if the detection current is "0". In other words, the current detector has an offset. Therefore, a command in which the offset is always applied thereto or subtracted therefrom is applied as a control signal of the inverter 5 to reduce the desired controlling characteristics. Thus, the cage 10 vibrates to deteriorate the riding comfort in the cage.

In order to eliminate the above-mentioned drawbacks, the offset of the current detector 13 is regulated to obtain the best controlling characteristics, but the offset amount is varied according to temperature changes or a longterm drift due to the characteristics of the current detector 13. Thus, since the offset of the current detector had to be regulated at every regulation, it was difficult to obtain a stable controll characteristics over a long period. Since the offsets of all the elevators must be regulated at the time of installing the elevators, there also arise drawbacks in the installation and the maintenance of the elevators.

SUMMARY OF THE INVENTION

The present invention has been made in order to eliminate the above-mentioned drawbacks and has for its object to provide a control device for an elevator, which can automatically regulate the offset to always obtain a stable control characteristics.

The control device for an elevator according to the present invention comprises a second current commanding circuit in addition to a usual current command, and offset regulating means for regulating the offset by a second current commanding circuit and a second subtractor circuit so that the current detection value of the output current detector of an inverter while an elevator is being stopped becomes a predetermined value or lower to control the command current value of the second current commanding circuit, thereby correcting the offset of the current detector.

In the control device of the elevator thus constructed as described above, even if the offset amount of the current detector is varied due to temperature changes or an aging change, the offset can be immediately corrected, stable controlling characteristics can always be obtained, and offset regulations by an operator can be eliminated at the time of installation and maintenance.

Figure 1:
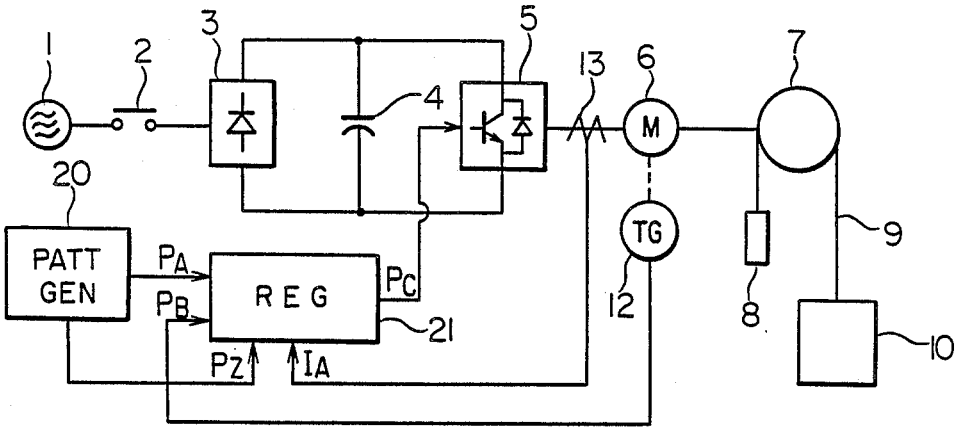
FIG. 1 is a view of the entire construction of an embodiment of a control device for an elevator according to the present invention.
Figure 2:
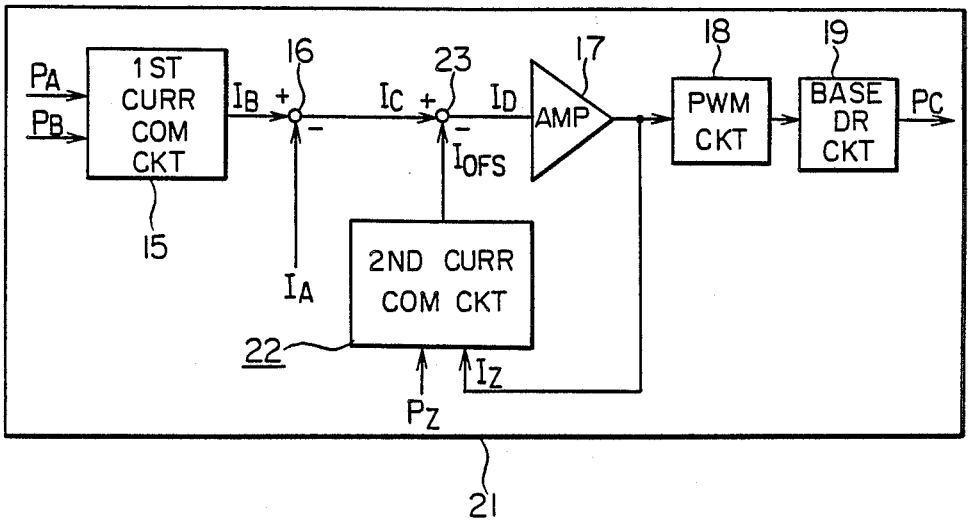
FIG. 2 is a block diagram showing in detail a regulator in FIG. 1.

In the drawings, the same symbol indicate identical or corresponding portions.

DESCRIPTION OF THE PREFERRED EMBODIMENT

Figure 5:
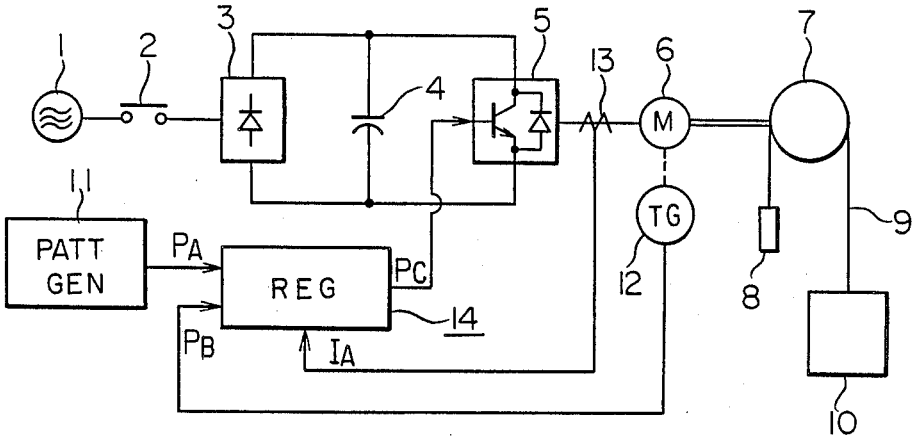
FIG. 5 PRIOR ART
FIG. 5 is a view of the entire construction of a conventional control device for an elevator.
Figure 6:
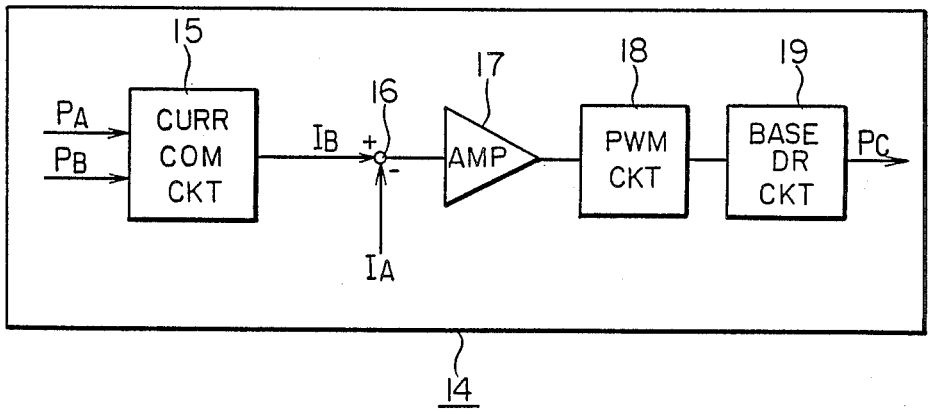
FIG. 6 PRIOR ART
FIG. 6 is a block diagram showing the detail of a regulator in FIG. 5.

An embodiment of the present invention will be described with reference to FIGS. 1 to 4. The same reference numerals as those in FIGS. 5 and 6 indicate identical or corresponding parts, and the detailed description thereof will be omitted.

In FIG. 1, numeral 20 designates a pattern generator, and numeral 21 designates a regulator. The pattern generator 20 outputs command speed signal $P_A$ and an elevator stopping signal $P_Z$. The regulator 21 has, as shown, for example, in FIG. 2, a first current commanding circuit 15, a first subtractor circuit 16, an amplifier 17, a PWM circuit 18, a base driver circuit 19, a second current commanding circuit 22 and a second subtractor circuit 23.

Figure 3:
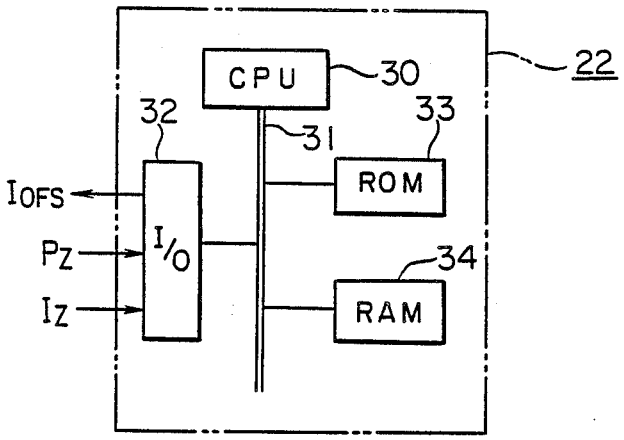
FIG. 3 is a block diagram showing in further detail the regulator in FIG. 1.
Figure 4:
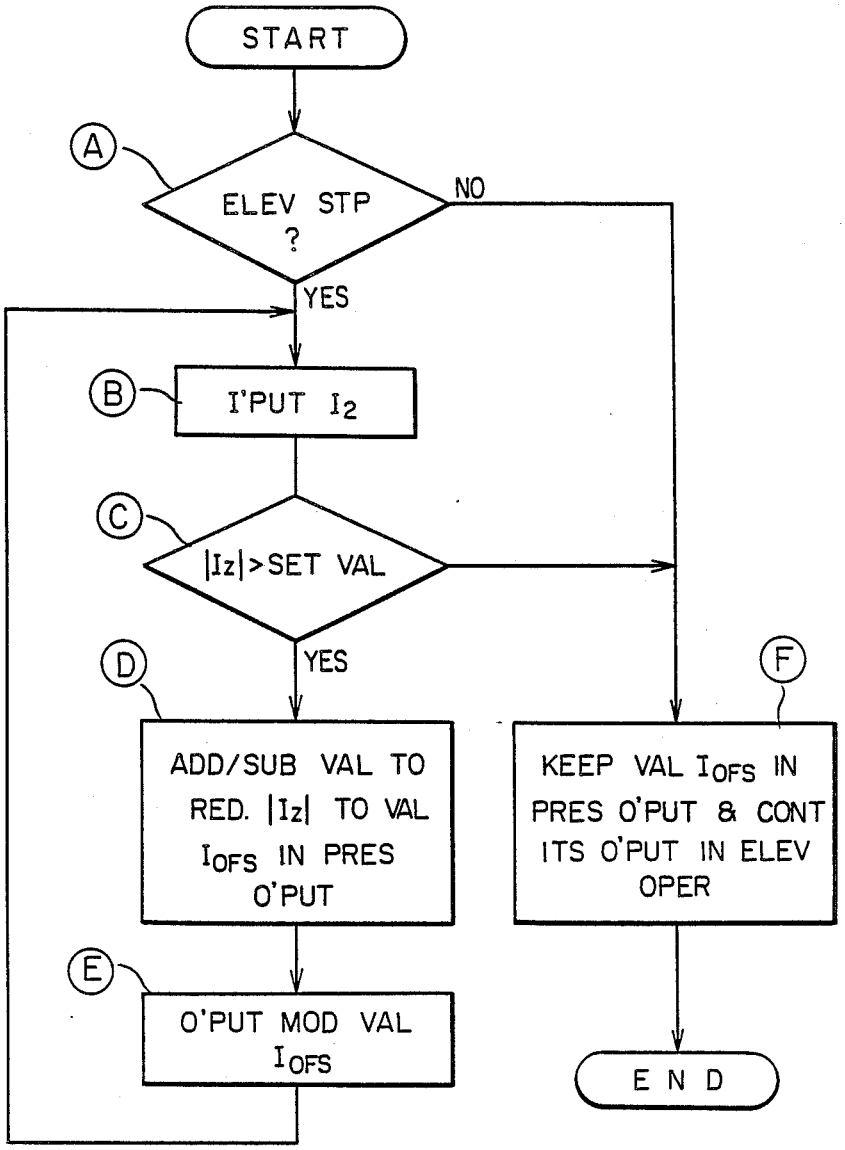
FIG. 4 is a flowchart for describing an offset regulating method.

The second current commanding circuit 22 has, as shown in detail in FIG. 3, a CPU 30, a bus 31, an input-/output unit 32, an ROM 33 for storing a program shown in FIG. 4, and an RAM 34 for temporarily storing input/output signals. When the elevator stopping signal $P_Z$ is input to the second current commanding circuit 22, the second commanding circuit 22 inputs the output signal $I_Z$ of the amplifier 17, outputs a command signal IOFS corresponding to $I_Z$, and continuously outputs $I_{OFS}$ during stopping while the elevator is operating.

The second subtractor circuit 23 subtracts the output signal $I_C$ of the first subtractor 16 from the command signal $I_{OFS}$ of the second current commanding circuit 22, and outputs an output signal $I_D$.

Next, the operation of this embodiment of the control device for the elevator constructed as described above will be described. In this embodiment, it is assumed that an offset is generated in the current detector 13 in the same manner as in the conventional example. A first command current $I_B$ is "$I_B=0$" during the elevator stopmode, and the detection current $I_A$ becomes "$I_A\neq 0$" due to the offset of the current detector 13. Therefore, the output signal $I_C$ of the first subtractor 16 becomes "$I_C\neq 0$". If the command current $I_{OFS}$ of the second current commanding circuit 22 is "$I_{OFS}=0$", the output $I_D$ of the second subtractor 23 becomes $I_D=I_C$, the output $I_Z$ of the amplifier 17 becomes "$I_Z\neq 0$", and a command other than "0" is output to the inverter 5 even during elevator stopmode. The second current commanding circuit 22 outputs a correction value $I_{OFS}$ so that the output value $I_Z$ of the amplifier 17 during the elevator stopmode of operation becomes a predetermined value or lower. Thus, the output $I_D$ of the second subtractor becomes $I_D=I_C-I_{OFS}\approx 0$, and the output $I_Z$ of the amplifier 17 can be controlled to $I_Z\approx 0$. Therefore, the output $P_C$ of the base driver 19 outputs a signal for correcting the offset of the current detector 13. The second commanding circuit 22 generates a command signal $I_{OFS}$ from the output $I_Z$ of the amplifier 17 in the sequence of a flow chart in FIG. 4, as will be described herebelow.

Step A: Judges whether the elevator is stopped or moving.

Step B: Inputs the output signal $I_Z$ of the amplifier 17 when it is determined that the elevator is stopped.

Step C: Judges whether the absolute value $|I_Z|$ of $I_Z$ is larger than a predetermined value or not.

If $|I_Z|$ is larger than the predetermined value, the flow is advanced to step D, and if $|I_Z|$ is smaller than the predetermined value, the flow is advanced to step F.

Step D: Adds or subtracts a value for reducing $|I_Z|$ to or from the $I_{OFS}$ value being output at present.

Step E: Outputs the value obtained in step D as a new $I_{OFS}$ value, and returns to the step B.

Similarly, the steps B to E are repeated until $|I_Z|$ becomes the predetermined value or lower.

Step F: Holds the $I_{OFS}$ value during the output at present when it is judged that $|I_Z|$ is the predetermined value or lower in the step D. This value is output while the elevator is operating.

In the step D, the value for reducing $|I_Z|$ obtain (1) a predetermined value, (2) a value obtained by multiplying the input $I_Z$ by a predetermined gain, a combination of (1) and (2). For example, since $|I_Z|$ is large at first, $I_{OFS}$ is obtained in (2). (The larger $|I_Z|$ is, the greater the varied value of $I_{OFS}$.) The second or later steps may obtain $I_{OFS}$ in (1).

Since the control device of the invention is constructed as described above, even if an offset is generated in the current detector 13, the offset amount is detected while the elevator is stopped, and the correction can be automatically performed. Therefore, better controlling characteristics are always obtained to suppress vibrations of the elevator, thereby improving the riding comfort of passengers in the elevator car.

The current detector 13 is explained as an example of an offset generation source. However, an offset is presented also in the circuits of the regulator, such as the first or second current commanding circuit 15, 22, first or second subtractor circuits 15, 23, etc. However, according to the embodiment described above, the output signal $I_Z$ when the cage of the elevator is stopped is set to the predetermined value or lower. Therefore, even if an offset exists in the amplifier 17 and the circuit in the stages before the amplifier 17, the output $I_Z$ of the amplifier 17 becomes a predetermined value or lower, and the offset can be reduced to a value which provides the best practical effects.

The subtractor is explained in terms of a first and a second subtractor. However, these subtractors may be readily composed of one circuit (i.e. a 3-input adder/-subractor). Further, the transistor inverter has been employed as the inverter, but even if it is composed of a thyristor inverter, the same object can be performed.

According to the present invention as described above, the offset of the current detector for detecting the output current of the power inverter is detected while the elevator is stopped, and is automatically corrected. Therefore, even if the offset amount is varied due to temperature change or aging, a preferable elevator control can always be performed. Since the offset regulation is eliminated, installation and maintenance work can be simplified.

What is claimed is:

1. A controller for an elevator comprising:

a power converter connected to an A-C power source for converting A-C power from the power source into a D-C power;

a power inverter for converting the D-C output of the power converter into an A-C power for driving a hoisting motor of the elevator, a first current commanding circuit for commanding the output current of said power inverter from the command speed pattern and the real speed signal of the elevator;

a current detector for detecting the output current of said power inverter, a first subtractor for outputting the difference between the command signal of said first current commanding circuit and the output signal of said current detector, subtraction value setting means for setting a subtracted value so that the subtracted result with the output of said first subtractor becomes a predetermined value or lower by the operation with the stop signal of said elevator and holding the subtracted value by the operation of the elevator with an operation signal, second subtractor for outputting the difference between the output of said first subtractor and the subtracted value of said subtracted value setting means, and power inverter control means for controlling said power inverter by the output signal of said second subtractor.

2. A control device for an elevator according to claim 1, wherein said first subtractor and said second subtractor are composed of one 3-input/1-output subtractor.

3. A control device for an elevator according to claim 1, wherein said power inverter is composed of a transistor.

4. A control device for an elevator according to claim 1, wherein said power inverter is composed of a thyristor.

5. A control device for an elevator according to claim 1, wherein said subtraction value setting means comprises an input/output unit, a ROM for storing a predetermined program, an RAM for temporarily storing input/output signals, and a CPU for controlling the subtraction value output.

6. A control device for an elevator according to claim 1, wherein said power inverter control means comprises an amplifier, a PWM circuit and a base driver.

7. A control device for an elevator according to claim 5, wherein said subtraction value setting means stores an operation program for setting a subtraction value by the operation with the stop signal of the elevator so that the subtracted result of the output of said first subtractor becomes a predetermined value or lower and holding said subtraction value.

* * * * *